US008376799B2

(12) United States Patent
Singh

(10) Patent No.: US 8,376,799 B2
(45) Date of Patent: Feb. 19, 2013

(54) RESCUE DEVICE FOR MAROONED VICTIMS

(76) Inventor: Jainendra Kumar Singh, Bihar (IN)

( * ) Notice: Subject to any disclaimer, the term of this patent is extended or adjusted under 35 U.S.C. 154(b) by 89 days.

(21) Appl. No.: 13/130,404

(22) PCT Filed: Nov. 19, 2009

(86) PCT No.: PCT/IN2009/000666

§ 371 (c)(1),
(2), (4) Date: May 20, 2011

(87) PCT Pub. No.: WO2010/058424

PCT Pub. Date: May 27, 2010

(65) Prior Publication Data

US 2011/0227354 A1 Sep. 22, 2011

(30) Foreign Application Priority Data

Nov. 24, 2008 (IN) ..... 2042/KOL/08

(51) Int. Cl.
*B63C 9/00* (2006.01)

(52) U.S. Cl. ..... 441/80; 441/83

(58) Field of Classification Search ..... 441/80, 441/83; 182/3; 5/89.1; 244/137.2
See application file for complete search history.

(56) References Cited

U.S. PATENT DOCUMENTS

| | | | | |
|---|---|---|---|---|
| 3,176,327 | A * | 4/1965 | Oberth | 441/83 |
| 3,421,165 | A * | 1/1969 | Pugh | 441/83 |
| 4,627,821 | A * | 12/1986 | Bradley et al. | 441/83 |
| 5,158,489 | A * | 10/1992 | Araki et al. | 441/80 |
| 5,427,557 | A * | 6/1995 | Lunden, Sr. | 441/82 |
| 7,168,110 | B2 * | 1/2007 | Girard et al. | 5/89.1 |
| 2002/0042234 | A1 | 4/2002 | Wallasch | |
| 2005/0250396 | A1 | 11/2005 | Hayles | |
| 2006/0065485 | A1 * | 3/2006 | Reed | 182/82 |
| 2006/0254857 | A1 * | 11/2006 | Zhou et al. | 182/142 |

FOREIGN PATENT DOCUMENTS

| | | |
|---|---|---|
| FR | 2561108 | 9/1985 |
| IN | 1704/KOL/2007 | 6/2009 |

* cited by examiner

*Primary Examiner* — Stephen Avila
(74) *Attorney, Agent, or Firm* — Jacobson Holman PLLC

(57) ABSTRACT

A rescue device for marooned victims consists of a pair of holding arms (10, 10') for holding the victims and a pair of seating arms (11, 11') for providing seating facility to the victim. A motor (20) mounted on top of holding arms (10, 10') moves arms (10, 10') and (11, 11') in a direction opposite to each other. The two pair of arms (10, 10') and (11, 11') rotate co-axially around main holding bar (40) in directions opposite to each other whenever motor (20) is activated without destabilizing the suspension above, wherein the holding arms (10, 10') are closed in for holding the victims body by the arc or V shaped structures (30, 30') when the seating arms (11, 11') are closed in for providing a seating facility (16) through electrical means (50) and lock (51).

4 Claims, 2 Drawing Sheets

RESCUE DEVICE FOR MAROONED VICTIMS

This is a national stage of PCT/IN09/000,666 filed Nov. 19, 2009 and published in English, which claims the priority of India number 2042/KOL/08 filed Nov. 24, 2008, hereby incorporated by reference.

FIELD OF INVENTION

This invention relates to a rescue device for a person trapped at an isolated and helpless spot as in flood waters, earthquakes etc. It can also be applied in rescue works from rooftops, crevasses in glaciers, ravines etc. where similar situations of emergency develop.

BACKGROUND OF THE INVENTION

Floods have become a common phenomenon nowadays. Rivers, canals and other water bodies often get flooded with increasing frequency due to sudden excessive rains and other reasons. These often spread beyond banks and submerge plains. People get trapped in such waters, get carried away or drowned if timely and effective rescue is not available. Similar emergencies occur in other kind of water bodies like sea, lakes, on ships, boats etc. where fast aerial rescue is only hope.

Aerial rescue is an effective mode for rescuing such victims. Prevalent methods followed in such aerial rescue involves lowering of a crew member of rescue team through a rope with harness, putting the victim into the harness and then lifting them up mostly one after another. This is a time taking process and involves a risky adventure for the rescue team. So it limits the scope and success rate of the operation considerably. These risks may be minimized and success probability can be enhanced if lowering of a rescue personnel is not required and rescue operation could be carried out and monitored from above, be it a craft or a vantage point on top in a relatively faster operation.

OBJECTS OF THE INVENTION

It is therefore an object of this invention to propose a rescue device for marooned victims which is simple to operate and is able to rescue a person trapped in such situation with ease, speed and less risk.

Another object of this invention is to propose an aerial rescue device for marooned victims in which no crew member is required to be lowered and the rescue operation is monitored through video control and a rescue team above.

BRIEF DESCRIPTION OF THE ACCOMPANYING DRAWINGS

The invention can now be described in detail with the help of the figures of the accompanying drawings in which.

DETAILED DESCRIPTION OF THE PREFERRED EMBODIMENT OF THE INVENTION

Figure 1:
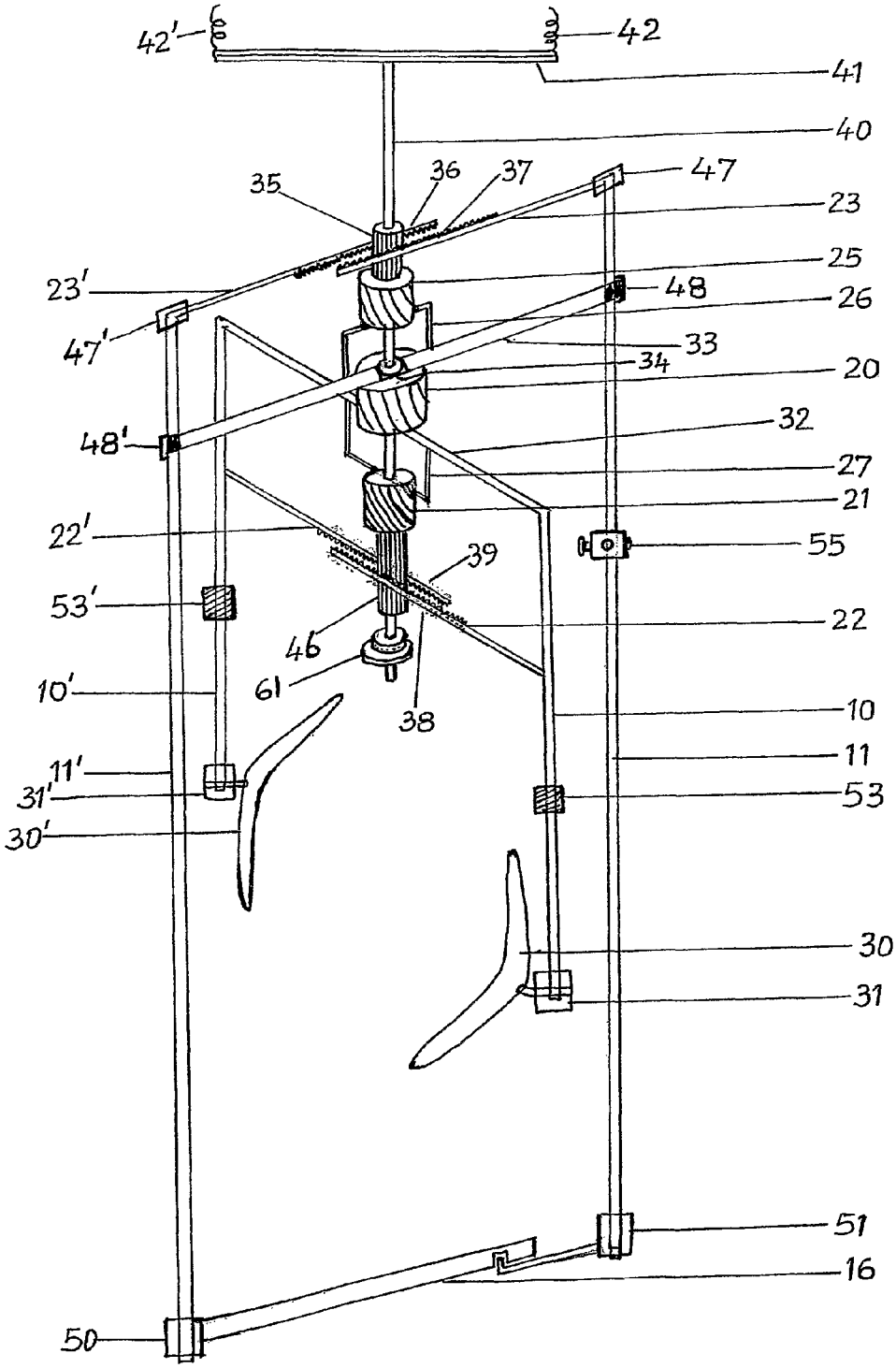
FIG. 1 shows the device with motors and camera and other parts.

The proposed device which hangs from a helicopter like craft or a spot above the victim's position through one or more ropes, chains or like material, consists mainly of two pairs of downward pointing opposite arms (10, 10') and (11, 11') all of which together make an enclosure which is open at the bottom. The two arms of one pair has at their bottom, arc or V like structures (30, 30') facing each other and capable of gripping and holding a victim firmly for the purpose of carrying him along more or less in the same manner as one holds a child below his armpits for lifting him up. These arms may henceforth referred to as the holding arms and their arc or 'V' shaped like structures can rotate around a horizontal axis through their points of attachment. The other pair of arms carries at their bottom, a two part seating facility (16) which can be assembled by converging them into a close in position and will be henceforth referred to as the seating arms. Each pair of opposite arms can converge closer to each other or open away preferably with the help of small motors (21, 25) provided for the purpose or alternative methods. Also, each of the aforesaid two pairs of arms can revolve, with respect to each other, around their common vertical axes preferably with the help of motor (20) provided for the purpose which is mounted on the top central point of one said pair of arms and the other pair's top central point is coupled with it's rotating pipe axle (34). So whenever this motor works, the two pair of arms rotates with respect to each other and in opposite direction to each other because both pairs of arms are freely rotatable around the vertical holding bar (40) which passes through said pipe axle (34) of the motor and through which these pair of arms are hanging. When one pair of arm is engaged in holding the victim only the other pair of arms will rotate. This facilitates their easy manouvring whenever required. All these operations are controlled by switches available with the rescuers above.

The said holding arms (10, 10') are meant for holding the victim somewhere between waist and shoulder, preferably around chest. In case when the victim is already in an upright posture, the device is oriented to bring the holding arms (10, 10') along his two sides and to the level of his chest and closed in so that it grips him below shoulders firmly through padded arc or 'V' shaped structures (30, 30'). Then the other pair of seating arms (11, 11') are revolved, if required, with the facility described above to bring it along front and rear of the victim in order to hold him on front and back and are actuated to close in till the seating facility (16) at bottom get assembled between his legs and the victim is seated thereon in the same manner as one sits on a bicycle.

In case when the victim is unconscious and in lying posture or is floating on water, the arc or 'V' shaped holding structures (30, 30') of the holding arms are rotated by the required degrees and manouvred to grip the victim's body along his chest. Having held the victim firmly, the whole is lifted out of water, the holding structures are rotated back by an extent to bring his body to an upright posture and then the other pair of arms are rotated to the front and rear position and closed in so that the seat gets assembled between his legs and victim is taken in it's fold firmly. It is then carried to a safe destination.

However in situations like this, the arc or 'V' shaped arms will be required to be deployed first but there may be some difficulty due to it normally being shorter in length than the other ones. For this a facility for increasing and decreasing it's length is also provided so that it's length can be altered whenever required.

This device can also be used for rescue works when a person, especially a child falls and gets trapped into a hole dug on earth for tube wells etc. in which case, the holding arms' length may be required to be increased first in order to hold the child to make him stand. The rest of the operations may follow later as described earlier.

A camera (55) for watching and monitoring the rescue operations is fitted either on a separate rotatable arm or on the front arm (11) preferably and connected to the video display with the rescue team on top or in the craft. It provides video support for the rescue operation.

FIG. 1 shows one embodiment of the invention in which (10, 10') is the said pair of holding arms and (11, 11') is the said pair of seating arms. The two pairs of arms revolve against each other through the motor (20) positioned in between them around a common vertical axis passing through the bar (40).

Here the said two pairs of arms can rotate freely around the vertical bar (40), which passes through pipe axle (34) of motor (20), without causing any spin in whole device. Motor (20) while being mounted rigidly on top of the pair (10, 10') rotates the other pair (11, 11'). So the two pairs of arms rotate in opposite directions to each other, the device itself remaining steady despite having non steady suspension above like rope or chain. The reverse rotational thrust generated by the rotation of seating pair of arms (11, 11') is spent in rotating the holding pair of arms (10, 10') and so is not transferred to the suspension above. Smooth rotation between holding bar (40) and two pair of arms is maintained through proper lubrication and bearings. The device hangs from above through the bar 40 attached to horizontal bar (41) hung through ropes or chains (42, 42'), which are well separated so that stability comes to the suspension without loss of much time. The two pairs of arms (10, 10') and (11, 11') are opened wide or closed in with the help of motors (21 and 25) and racks (36, 37) and pinion (35) and racks (38, 39) and pinion (46) when the pinions are deployed in between the racks respectively. Hinges (47, 47') and (48, 48') are provided at corners of the two pairs of arms to facilitate opening wide and closing in of the two pair of arms (10, 10') and (11, 11'). The motor (25), which is mounted on top of pair of arms (11, 11') through supporting structure (26), moves linking bars (23, 23') inwards or outwards in order to open or close in arms (11, 11') as desired. Similarly, motor (21) is mounted in an inverted posture through supporting structure (27) opens or closes in arms (10, 10') by moving bars (22, 22') accordingly. The bars (23, 23') and (22, 22') have at the ends racks (36, 37) and (38, 39) cut on it. Motor Shaft is a pipe shaft (34) through which the bar (40) passes through motor (20) and is responsible for rotating rod (33) around a vertical axis whereas rod (32) rotates in opposite direction simultaneously so that hanging arrangement is not disturbed or twisted. The bar (40) passes through the pinion (35) of the motor (25), pipe shaft (34) of the motor (20) and pinion (46) of the motor (21) in such a manner that pinions and the shaft rotate freely around the bar (40). The extended part of pipe shaft (34) of the motor (20) is welded to the rod (33) of the arm (11, 11"). Motor (21) is welded to the structure (27) fixed with rod (32). Arc or 'V' shaped structures (30, 30') which hold the victim's body, are rotated with the help of Motors (31, 31'). Since only a limited rotation of (30, 30') is required, this action may alternatively be carried out by rescuers with the help of strings etc. running from (30, 30') to the craft. Likewise folding or unfolding of seating facility at the bottom of the seating arms (11,11') are carried out preferably through electrical means at (50) and locking facility at (51) when, (53 and 53') are electrical, mechanical or some other facilities in the holding arms (10, 10') for increasing or decreasing length of these arms. A stopper (61) with a ball bearing over it is provided at the bottom of main vertical bar (40) to hold all the aforesaid constituents in place and prevent these to slide down.

Figure 2:
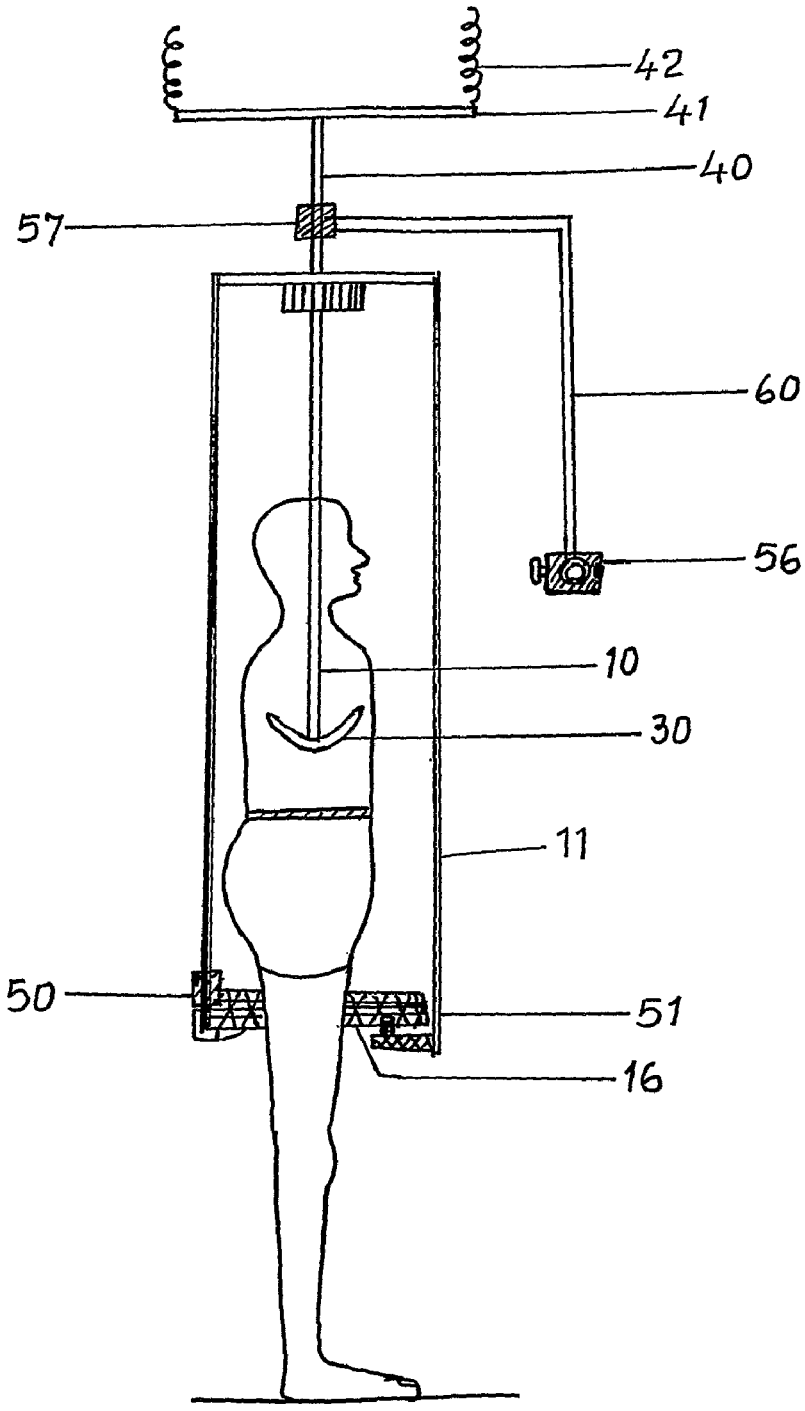
FIG. 2 shows the device holding a victim in its fold.

A camera has been shown at (55), fitted in the front arm (11) in FIG. 1 which provides video support for the rescue operation. It will have a tilting facility for its lens so that it covers the operations even when arms (11, 11') are in open position. Alternatively, there may be a separate revolving arm (60) attached to main bar (40) with revolving facility at (57) for the camera as in FIG. 2, which shows the basic functioning of the device with two pairs of arms holding the victim within its fold.

The following advantages can be seen in the proposed invention:— i) Quick response and reliability makes this device unique.

ii) No member of the rescue team has to be lowered for putting the victim into rescue harness;

iii) The above minimizes the risk involved for the said rescuer and much of precious time is saved during rescue.

iii) The proposed device can even try to pick a victim floating or partly submerged in water, which is not possible with prevalent methods.

v) Reduction in time taken in rescue enhances the efficiency and security manifold.

What is claimed is:

1. A rescue device for marooned victims comprising:

a plurality of holding arms for holding the victim on his sides;

a plurality of seating arms for providing seating facility to the victim as well as holding the victim on front and back;

a motor mounted rigidly on top of the holding arms;

a motor mounted on top of pair of arms through supporting structure;

a motor mounted on pair of arms through supporting structure;

an arc or 'V' shaped structure for holding the victim's body;

a camera 55 fitted in the front arm for providing video support for the rescue team;

a two part seating and locking facility;

a main holding bar or pipe passing loosely through pipe shaft of motor and through holes at top central points of holding arms and seating arms;

characterized in that, the two pair of arms and rotate coaxially around main holding bar in directions opposite to each other whenever motor is activated without destabilizing the suspension above, wherein the holding arms are closed in for holding the victims body by the arc or 'V' shaped structures when the seating arms are closed in for providing a seating facility through electrical means and lock.

2. The device as claimed in claim 1, wherein the bar passes through the pipe shaft of motor for rotating the rod around a vertical axis.

3. The device as claimed in claim 1, wherein the bar attached to horizontal bar hangs through ropes or chains.

4. The device as claimed in claim 1, wherein motors and racks with pinion and racks with pinion are deployed for opening wide and closing in of the two pair of arms and.

* * * * *